US005520984A

United States Patent [19]

Gulino

[11] Patent Number: 5,520,984

[45] Date of Patent: May 28, 1996

[54] GLASS-STRAND MESH AND COMPOSITE MATERIAL REINFORCED THEREBY

[75] Inventor: Joseph Gulino, Meylan, France

[73] Assignee: Vetrotex France, Chambery, France

[21] Appl. No.: 361,499

[22] Filed: Dec. 22, 1994

[30] Foreign Application Priority Data

Dec. 24, 1993 [FR] France ..... 93 15604

[51] Int. Cl.[6] ..... B32B 5/12

[52] U.S. Cl. ..... 428/107; 428/113; 428/175; 428/254; 428/542.8

[58] Field of Search ..... 428/253, 107, 428/113, 175, 254, 542.8

[56] References Cited

U.S. PATENT DOCUMENTS

| | | | |
|---|---|---|---|
| 3,819,461 | 6/1974 | Saffadi | 161/58 |
| 4,988,469 | 1/1991 | Reavely et al. | 264/113 |

FOREIGN PATENT DOCUMENTS

| | | |
|---|---|---|
| 1469065 | 2/1967 | France . |
| 2278818 | 2/1976 | France . |
| 2416715 | 9/1979 | France . |
| 2558180 | 7/1985 | France . |
| 2594858 | 8/1987 | France . |

OTHER PUBLICATIONS

Database WPI, Derwent Publications, AN-80-75991C, JP-55-117649, Sep. 11, 1980.

Database WPI, Derwent Publications, EP-198776, Oct. 22, 1986.

*Primary Examiner*—Christopher W. Raimund

*Attorney, Agent, or Firm*—Oblon, Spivak, McClelland, Maier & Neustadt

[57] ABSTRACT

A mesh of parallel glass strands useful as reinforcement for an organic substance, and the resulting composite material.

The mesh is constituted by a plurality of continuous glass strands arranged parallel to one another in the form of a flat sheet, the strands being bound to one another by strands disposed transverse to the sheet according to a weaving method known as chain stitching, the glass strands being partially joined together by means of a thermoplastic, organic binding agent and the stitch bonded strands having a modulus of elasticity lower than that of the glass strands and a melting or softening point higher than the melting or softening point of the binding agent.

11 Claims, 1 Drawing Sheet

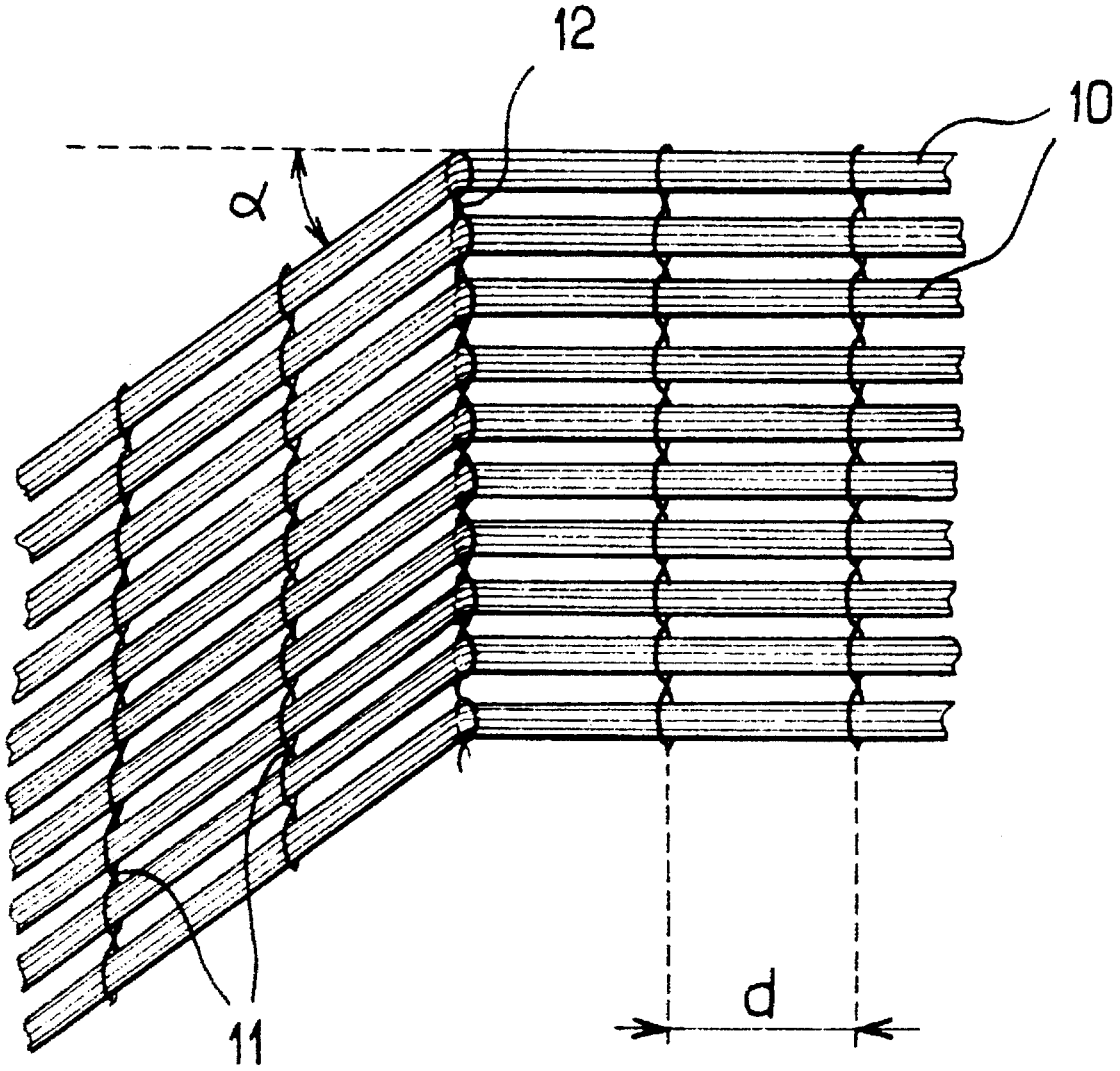
12
10
α
11
d

GLASS-STRAND MESH AND COMPOSITE MATERIAL REINFORCED THEREBY

BACKGROUND OF THE INVENTION

1. Field of the Invention

The present invention relates to a mesh of parallel glass strands which is useful as a reinforcement material for organic mixtures.

2. Description of the Background Art

Glass strands can be used in many ways for reinforcing thermosetting or thermoplastic organic substances. When composite articles produced from reinforced substances of this type are to be mechanically stressed during their intended use, the article is typically formed from glass strands oriented in a preferred direction. An article of this type is often produced by the impregnation, with an organic substance, of a plurality of layers of glass strands which are in the form of unidirectional sheets.

The production of complex reinforced composite articles of this type comes up against several difficulties, however. The first problem lies in the fact that the strands constituting the sheets may be deformed or displaced relative to one another during the handling operations which take place between the moment when the glass sheets are manufactured and the moment when the composite element is produced.

In order to solve this problem, it is known, according to French patent FR-A-2 594 858, incorporated herein by reference, to produce a sheet of parallel strands, for example, glass strands, which are assembled with the aid of hot-melting binding strands. A sheet is produced, the strands of which cannot be displaced relative to one another, owing to a heat treatment which melts the binding strands and thereby brings about bonding between the glass strands. After this treatment, the sheet can be handled or cut up without risk of deformation. The rigidity thus conferred on such a sheet hampers, however, any further deformation to which it would be desirable to subject it during the production of a composite article.

The second difficulty lies in the production of a complex composite article in which parallel reinforcements are oriented in at least two different directions in a plane in order to follow the shape of the said article. In fact, an article of this type currently requires the juxtaposition of at least two sheets of parallel reinforcements in two different orientations. This division of reinforcements results in a discontinuity at the transition from one sheet to the other. Whether the region in which the discontinuity is disposed in is on the surface or within the body of the composite article, if it is subjected to stresses, overstressing will appear in this region with a consequent risk of rapid degradation of the material. Moreover, the different orientations of the reinforcing sheets also lead to overstressing along the entire periphery of the article of composite material.

SUMMARY OF THE INVENTION

Accordingly, one object of the present invention is to provide a mesh of parallel glass strands such that the strands can be used as reinforcement in a complex composite article, preventing any discontinuity within the body of the said article.

Another object of the present invention is to provide a mesh of parallel strands which can be deformed, and which has sufficient stability to be handled without risk of causing accidental displacement of one or more strands during the production of a complex composite article.

Another object of the present invention is to provide a mesh of parallel glass strands in which the method of binding the strands to one another is such that it has practically no effect on the fatigue strength of a composite article in which the mesh serves as reinforcement.

Yet a further object of the present invention is to provide a composite material reinforced by a mesh of parallel glass strands of this type.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a portion of a glass-strand mesh according to the invention.

DETAILED DESCRIPTION OF THE INVENTION

The above objects have been achieved by the discovery of a mesh of parallel glass strands which is intended to be associated with an organic mixture in order to produce a composite material, the mesh being wholly or partially made up of a plurality of continuous glass strands arranged parallel to one another in the form of a flat sheet, the strands being bound to one another by stitch bonded strands disposed transverse to the sheet and prepared according to a weaving method known as chain stitching, the glass strands being partially joined together by means of a thermoplastic, organic binding agent and the stitch bonded strands having a modulus of elasticity lower than that of the glass strands and a melting or softening point higher than the melting or softening point of the binding agent.

The handling of the invention glass sheet, the deformation of the parallel-glass-strand mesh associated therewith, and the retention of this deformation are greatly facilitated by the deposition of an organic substance in liquid or powder form on the surface of the sheet. The quantity by weight of organic substance deposited is generally more than 0.5% relative to the weight of the sheet and, preferably, less than 2%. For convenience, this deposited organic substance will be referred to in the following description as the "binding agent".

The binding agent is deposited at a temperature below its softening or melting point and is heated to a temperature above its softening or melting point on the surface of the sheet to ensure the adhesion of the binding agent to the surface of the sheet. Softening means the change from the solid phase to a phase which is sufficiently viscous to ensure the adhesion of the binding agent to the sheet. The softening or melting point of the binding agent selected is generally above about 40° C. and below about 130° C.

After the binding agent and the sheet have cooled and returned to a temperature below this softening or melting point, the sheet has a state of consolidation such that its handling is greatly facilitated. Consolidation means a state such that the intrinsic characteristics of the parallel-glass-strand mesh and of the deformed sheet are not altered by subsequent handling.

One of the advantageous characteristics of the glass-strand mesh according to the invention is its ability to be deformed, for example, in a plane, in a manner such as to change the orientation of the glass strands constituting the sheet in a specific region. This change of orientation is effected, for the strands of the sheet as a whole, relative to one of the transverse strands which bind the glass strands. For convenience, these transverse strands will be referred to in the following description as stitch bonded strands. This change of orientation can thus produce the equivalent of two sheets connected to one other with the formation of a well-defined angle between them.

The geometrical deformation of the parallel-glass-strand mesh should take place at a temperature above the softening or melting point of the binding agent. After the glass-strand mesh thus deformed has returned to a temperature lower than the softening or melting temperature of the binding agent, it also has a consolidation state such that its handling is greatly facilitated and its deformation geometry is easily retained.

One of the advantageous characteristics of the strand mesh according to the invention is that the stitch bonded strands used are made of a material, the melting or softening point of which is higher than the melting or softening point of the binding agent. The mesh can thus be deformed and consolidated by cooling in several stages without ever losing the potential for orientation of the glass strands extending through the loops of the chain stitching.

During the production of a composite material reinforced by a parallel-glass-strand mesh of the type according to the invention, when the stitch bonded strands are made of glass, they considerably reduce the fatigue strength of the material because of the effects of transverse orientation relative to the principal direction of mechanical stressing of the material.

A phenomenon of this type is markedly reduced if the stitch bonded strand is made of a material of which the modulus of elasticity is lower than that of glass. Even more preferred is a material having a modulus of elasticity close to that of the organic matrix to be reinforced.

The prepared method of binding the strands of the sheet of the mesh according to the invention is chain stitching and, preferably, closed-stitch chain stitching. This chain-stitch binding method allows the strands of the glass sheet to be kept taut and without ripples within the body of the sheet, which considerably increases the fatigue strength of a composite material formed by a reinforcement of this type. Moreover, this binding method enables a defined uniform spacing to be maintained between the glass strands of the sheet to ensure a good flow of the organic resin within the body of the reinforcement during a moulding stage used to produce a composite material.

Finally, owing to its cohesion, this binding method prevents any risk of random displacement of the glass strand rovings during any moulding stage when injection or compression pressure becomes high, which improves the reproducibility of the moulded articles.

The strand selected as the binding or chain-stitching strand or stitch bonded strand is preferably an organic strand. When the strand mesh according to the invention is intended to reinforce a certain organic substance, the binding or chain-stitching strand may be constituted by an identical or similar substance.

The deformability of the glass-strand mesh according to the invention is closely dependent on the space separating two consecutive binding or chain-stitching strands. To achieve bending of the parallel-strand sheet in a plane without causing pleats or ripples, the smallest space between two consecutive stitch bonded strands is preferably at least 5 millimeters. The stitch bonded strands in the strand mesh according to the invention are generally evenly spaced.

In the strand mesh, the glass strands may be distributed in the sheet in the form of a series of rovings, each roving being formed by the combination of several strands. Within the scope of the invention, the rovings forming the sheet preferably have a fineness of at least 300 Tex. Whether or not the glass strands are distributed in the form of rovings, they are themselves preferably constituted by a plurality of continuous filaments, the average diameter of which is at least 10 micrometers.

The strand mesh according to the invention is used to reinforce thermosetting or thermoplastic organic substances. The composite material produced comprises at least one layer of a mesh according to the invention. In this material, the mesh may be deformed relative to at least one stitch bonded strand in a manner such that the strands are divided into at least two sets of parallel strands between which a specific angle is formed. The composite material may thus comprise one or a plurality of parallel-strand sheets which have remained flat after one or a plurality of deformations. In this case, each deformation consists simply of a pivoting of each strand or roving, in the initial plane, about several chain stitches of a specific stitch bonded strand.

The composite material may also comprise one or a plurality of sheets which, after one or a plurality of deformations, have a curvature or bend relative to the initial plane of the sheet. In this case, each deformation consists of a pivoting of each strand or roving about at least one stitch bonded strand selected as the deformation axis, so as to form a specific angle relative to the initial plane of the sheet. In this manner the parallel-strand mesh according to the invention thus enables complex three-dimensional composite articles to be produced.

The advantages of the present invention will be better understood by means of the embodiment described below, which is illustrated by FIG. 1. The invention is not limited to this embodiment, however.

As shown in FIG. 1, an invention mesh is constituted by a series of layered-strand rovings 10 disposed parallel to one another in a plane. Each roving has a fineness of 1200 Tex and is made up of filaments, the average diameter of which is of the order of 17 micrometers. The sheet of rovings 10 is kept in position by a polyester strand 11 with a fineness of 50 dTex which is closed chain stitched. The rovings 10 are bound to one another by the chain stitching with the use of a warp knitting machine. The space "d" between two consecutive chain stitches is 8 millimeters.

An shown in FIG. 1, the mesh can be deformed relative to the chain stitching 12. The rovings 10 have pivoted through an angle $\alpha$ whilst remaining in plane by using the loops of the chain stitching 12 as hinges. This change of orientation is effected without the formation of pleats or ripples in the sheet. The same mesh can be deformed in plane or out of plane relative to a plurality of chain stitches in order to follow complex shapes. By virtue of this flexibility, the mesh according to the invention can perform the same function as a plurality of juxtaposed, differently-oriented sheets, but without having discontinuities from one end of the glass-strand sheet to the other.

A flat plaque, 70 cm. long and 10 cm. wide and curved at its two ends was produced by stacking 10 sheets of a mesh of invention glass-strand roving. Each layer was formed by a mesh of glass rovings on which a thermoplastic binding or agent had been deposited in powder form beforehand. This binding agent, which was deposited in a proportion of 1% of the weight of glass, was a polyester marketed under the name NEOXIL 940 HF-2B by DSM. The deformation of the mesh was consolidated by cooling after heat treatment at 80° C. The stack formed was impregnated with a resin material of D.E.H. 39 and D.E.R. 332 made by Dow Chemical.

The present application is based on French application 93/15604 filed Dec. 24, 1993, incorporated herein by reference. Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A mesh sheet of parallel strands consisting essentially of a plurality of continuous glass strands arranged parallel to one another in the form of a flat sheet, the glass strands being bound to one another by stitch bonded strands disposed transverse to the sheet and prepared by a chain stitching weaving method, the glass strands being partially joined together by means of a thermoplastic organic binding agent, the stitch bonded strands having a modulus of elasticity lower than that of the glass strands and a melting or softening point higher than the melting or softening point of the binding agent.

2. The mesh sheet according to claim 1, wherein the melting point of the binding agent is between about 40° and 130° C.

3. The mesh sheet according to claim 1, wherein the stitch bonded strands are spaced evenly with a spacing of at least about 5 millimeters.

4. The mesh sheet according to claim 1, wherein the glass strands are distributed in the sheet in the form of a series of rovings, each roving having a fineness of at least 300 Tex.

5. The mesh sheet according to claim 1, wherein the glass strands are constituted by filaments the average diameter of which is at least 10 micrometers.

6. A composite material comprising a thermosetting or thermoplastic organic material reinforced by glass strands, wherein said material contains at least one glass-strand containing mesh sheet as defined in claim 1.

7. The composite material according to claim 6, wherein the at least one mesh sheet is deformed along an axis corresponding to at least one stitch bonded strand in a manner such that the mesh glass strands are divided into at least two sets of parallel strands between which a specific angle is formed.

8. The composite material according to claim 7, wherein the mesh sheet is deformed while remaining in a single plane, each strand or roving forming said sheet having been pivoted about an axis perpendicular to the sheet.

9. The composite material according to claim 6, comprising at least two glass strand containing mesh sheets, said organic material being an epoxy resin, said stitch bonded strands being made of polyester.

10. The composite material of claim 6, wherein said organic material is an epoxy resin and said stitch bonded strands are polyester strands.

11. The mesh sheet according to claim 1, wherein said thermoplastic organic binding agent is present in an amount of more than 0.5% and less than 2% by weight relative to the sheet.

* * * * *